US006199787B1

(12) United States Patent
Jaffar et al.

(10) Patent No.: US 6,199,787 B1
(45) Date of Patent: Mar. 13, 2001

(54) METHOD OF TRANSFERRING INDIVIDUAL ENDS OF YARNS FROM A BEAM TO INDIVIDUAL CONES

(76) Inventors: Asif Jaffar; Mohammad Ismail Jaffar, both of A/4A Manghopir Rd. S.I.T.E., Karachi (PK), 75700

( * ) Notice: Subject to any disclaimer, the term of this patent is extended or adjusted under 35 U.S.C. 154(b) by 0 days.

(21) Appl. No.: 09/306,384

(22) Filed: May 6, 1999

Related U.S. Application Data

(63) Continuation-in-part of application No. 09/032,841, filed on Mar. 2, 1998, now abandoned.

(30) Foreign Application Priority Data

Jun. 29, 1998 (WO) ..... 9811397

(51) Int. Cl.[7] ..... B65H 23/18

(52) U.S. Cl. ..... 242/418.1; 242/420.6; 242/472.8; 28/190; 28/194; 28/202

(58) Field of Search ..... 242/418.1, 420.5, 242/420.6, 412.2, 472.8; 28/172.1, 190, 194, 200, 202, 212

(56) References Cited

U.S. PATENT DOCUMENTS

| | | | | |
|---|---|---|---|---|
| 1,019,173 | * | 3/1912 | Miller | 28/190 |
| 1,289,015 | * | 12/1918 | Suter | 28/212 |
| 2,126,271 | * | 8/1938 | Moran | 28/194 |
| 2,943,809 | * | 7/1960 | Garrett | 242/418 |
| 3,330,016 | * | 7/1967 | Smith et al. | 28/212 |
| 4,137,614 | * | 2/1979 | Wolstencroft | 28/172.1 |
| 4,525,905 | * | 7/1985 | Bogucki-Land | 28/194 |
| 4,530,471 | * | 7/1985 | Inoue | 242/420.6 |
| 4,973,006 | * | 11/1990 | James | 242/472.8 |
| 5,343,601 | * | 9/1994 | Schippers | 242/472.8 |
| 5,588,194 | * | 12/1996 | Ulbrich et al. | 28/194 |

FOREIGN PATENT DOCUMENTS

| | | | | |
|---|---|---|---|---|
| 228807 | * | 7/1987 | (EP) | 242/420.6 |
| 17298 | * | 5/1971 | (JP) | 28/172.1 |

* cited by examiner

*Primary Examiner*—Donald P. Walsh
*Assistant Examiner*—Emmanuel M. Marcelo
(74) *Attorney, Agent, or Firm*—Parent Patent Res.; Papan Devnani, Esq.; C. C. Shroff

(57) ABSTRACT

A method of winding yarn into hanks, comprising the steps of loading a beam having a sheet of parallel ends of yarn wound thereon onto a rotatable beam stand; unwinding the sheet from the beam and passing the sheet through a nip between two reciprocating rolls; separating the parallel ends of yarn in the sheet from each other; and guiding each of the separated ends of yarn to a rotatable reel. The ends of yarn are then wound onto the rotatable reel by rotating the beam to release the sheet wound thereon; rotating the interacting rolls to draw the sheet through the nip; and rotating the reel to wind each separated end of yarn onto the reel. The rotational velocity of the beam and of the reciprocating rolls are controlled so as to keep the tension on the sheet of yarns below a defined value. By controlling tension, one reduces the likelihood of thread breakage and causes the yarns to be wound onto the reels in the form of loose hanks. The yarn may be easily unwound from the loose hanks and wound into cones for knitting and weaving.

11 Claims, 7 Drawing Sheets

METHOD OF TRANSFERRING INDIVIDUAL ENDS OF YARNS FROM A BEAM TO INDIVIDUAL CONES

This appln. is a C-I-P of Ser. No. 09/032,841 filed Mar. 2, 1998, abnd.

FIELD OF THE INVENTION

The invention relates to packaging of yarn for use by the consumer. More particularly, the invention relates to the treatment of a sheet of individual ends of yarn which have been dyed and wound onto a beam. The sheet of ends of yarn is unwound from the beam, with subsequent separation and packaging of each end of yarn into a form suitable for knitting and/or weaving.

BACKGROUND ART

There are several methods of packaging dyed yarn. Generally, the choice of packaging method depends on how the yarn was dyed, and on the intended end use of the yarn.

Package dyed yarn is prepared by winding undyed yarn into a cone form, and causing dye to penetrate the yarn under pressure. While this process may be used for dyeing yarn with reactive dyes, vat dyes, and direct dyes, it is not suitable for indigo dyes or sulfur dyes. Package dyed yarn has the advantage that cone-form yarn packages may be used for to make either woven fabrics or knitted fabrics. However, yarn which is dyed in this fashion is susceptible to undesirable shrinkage or weight loss.

Rope dyeing may be used for Indigo, sulfur and vat dyes, but not for reactive or direct dyes. Yarn is dyed in the form of a rope having many individual threads by passing the rope through from 2 to 7 dye-baths, and then oxidizing the dyed rope in air. A rope having about 320 threads is commonly used. The individual threads in the rope are separated and wound onto a beam. The threads on the beam may then be used for weaving.

Alternatively, the rope dyed threads on the beam may be transferred to cones for knitting. This is done by separating the threads on the beam into several groups of threads, and winding each group of threads onto a spool. For example, 8 spools having 40 threads each may be made from a beam carrying 320 threads. The threads on each spool are then unwound, and separated into individual threads. Each individual thread is wound onto a bobbin. The thread on a given bobbin may then be transferred to a cone. This is a time-consuming process, and the multiple transfer steps increase the possibility of thread breakage. The possibility of thread breakage also increases as the threads become finer, or as the number of threads transferred at one time increases.

The slasher process is another method for dyeing yarn. It may be used with Indigo, sulfur, vat, reactive and direct dyes. Typically, a sheet or web of substantially parallel and non-entangled warp yarns is passed through several dye baths in sheet form, washed, dried, and wound onto a beam. For reactive dyes, the sheet of warp yarns can be passed through 2 or 3 dye baths, and is then dried on hot cylinders for thermo-fixation at a temperature of 140–150° C. for about a minute prior to washing. After washing, the sheet of warp yarns is wound onto a beam. For vat and Indigo dyes, the sheet of yarn passes through several dye baths. The sheet is then oxidized chemically or by passing the sheet through air, and wound onto a beam after washing and drying. The slasher process can also be used to dye yarn in sheet form with sulfur dyes or direct dyes. With the slasher process, different colors can be dyed simultaneously, as different groups of threads can be dyed in different dyebaths and then brought together on a single beam after drying. In package dyeing, only one color can be dyed at a time.

The slasher process of dyeing yarn has major advantages over the cone dyeing process. Slasher dyeing of a sheet of yarn is a continuous process, whereas cone dyeing is a batch process. Also, with the slasher process, the color of the yarn can be observed during the dyeing process, allowing color corrections to be carried out immediately. With cone dyeing, the color of the yarn is not seen until the dyeing process is complete, making color correction difficult at best.

Also, the slasher process is cheaper than the cone dyeing process, as smaller amounts of chemicals are used in dyeing the same weight of yarn. Also, cone dyeing calls for greater inputs of water and energy.

However, the slasher process as currently used has a significant disadvantage over cone dyeing and rope dyeing. Specifically, a sheet of warp yarns wound onto a beam after being dyed by the slasher process may not be conveniently used for knitting. To date, an effective method of transferring yarn dyed by the slasher process from the beam to cones for use in knitting or as filling yarns in weaving has not been developed.

DISCLOSURE OF THE INVENTION

It is a first object of this invention to provide a process of transferring yarn dyed by the slasher process from a beam to a plurality of cones for use in knitting or weaving. While rope-dyed yarn may be transferred from beams to cones, this process is not able to provide cones of yarns dyed with reactive or direct dyes. While cone dyeing provides yarn dyed with reactive or direct dyes in a form suitable for knitting, cone dyeing is significantly more expensive than the slasher process.

It is a second object of this invention to provide a process of transferring each of a plurality of warp yarns in a sheet wound on a beam onto an individual cone with reduced risk of thread breakage.

These objects are accomplished by a process of winding yarn from a beam into loosely wound hanks. A sheet of substantially parallel warp yarns is dyed by the slasher process using a direct dye, an Indigo dye, a reactive dye, a vat dye, or a sulfur dye and wound onto a beam. Each of the individual warp yarns making up the sheet wound onto the beam is a single end of yarn.

At least one such beam is then loaded onto a first rotatable beam stand or drive. The end of the sheet of warp yarns is then unwound from the beam and guided through a nip between two interacting rolls. After the sheet passes through the nip, the parallel ends of yarn in the sheet are separated from each other. Each of the separated ends of yarn is then individually guided to an elongated rotatable reel on a hank reeling machine. Each of the ends of yarn is then wound onto the rotatable reel by simultaneously rotating the beam to release the sheet of warp yarns wound thereon; rotating the interacting rolls at a speed effective to draw the sheet of warp yarns through the nip without exerting excessive tension on the sheet; and rotating the reel at a speed effective to wind each separated end of yarn onto the reel without exerting excessive tension on the separated warp yarns. Each separated end of yarn winds onto the reel in the form of a loosely wound hank.

Preferably, the tension on the sheet leaving the beam and the tension on the warp yarns leaving the interacting rolls are monitored. The rotational velocity of the beam and the rotational velocity of the interacting rolls are each controlled by a compensator rolls and regulator and may be adjusted if the tension on the sheet or the tension on the warp yarns changes. Also, by monitoring tension, the speed at which yarns are wound into hanks may be increased in a controlled manner without increasing tension on the yarns.

Thus, the process of the invention allows individual yarns to be transferred directly from a beam to an individual package. Also, by controlling the tension on the yarn and the hank winding speed during this process, the risk of yarn breakage is greatly reduced.

The invention also encompasses the apparatus for transferring yarn from a beam to individual hanks.

BEST MODE FOR CARRYING OUT THE INVENTION

Figure 1:
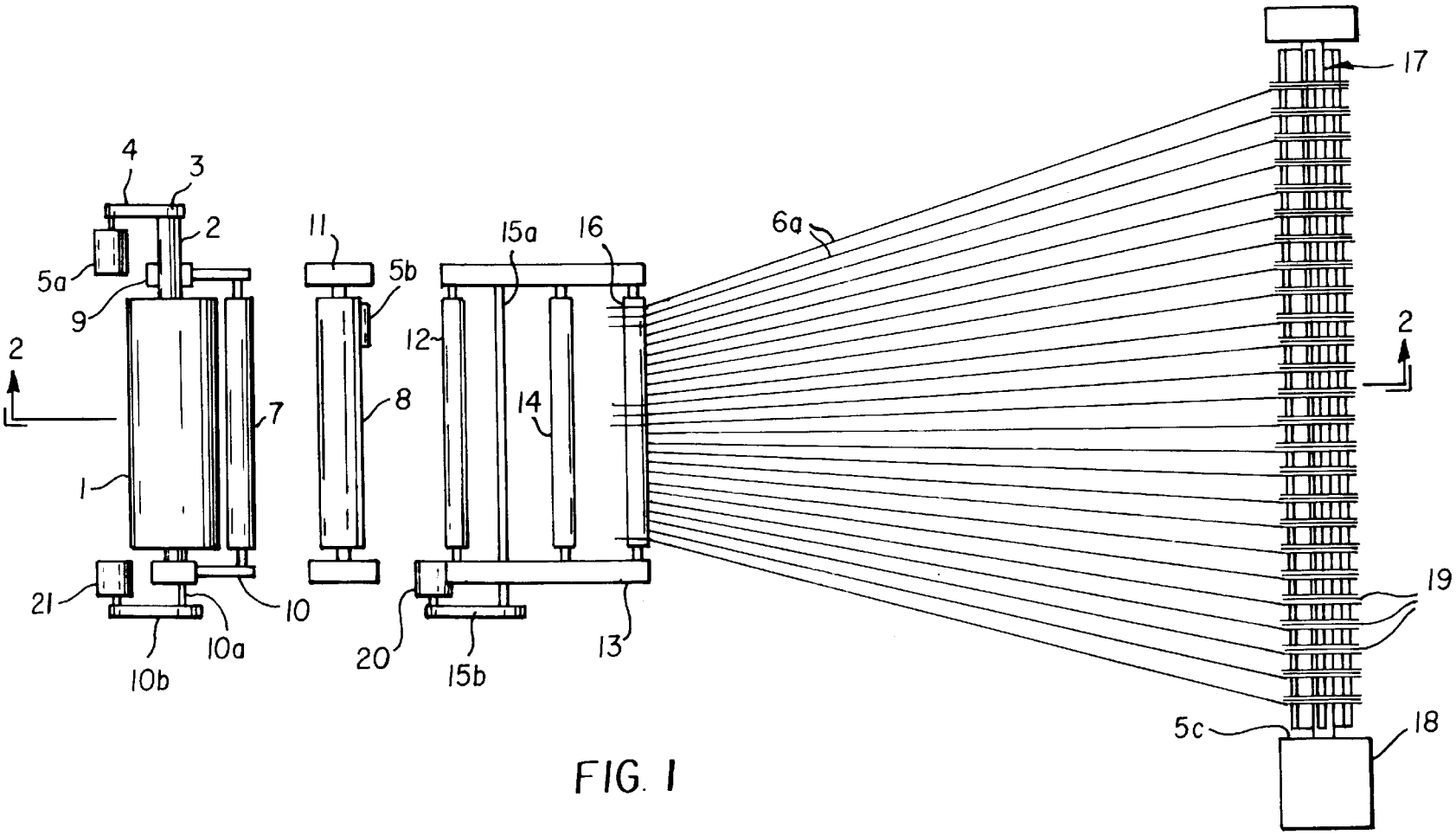
FIG. 1 shows a top view of the apparatus used to carry out the inventive process.

The method of transferring individual yarns from a beam to individual hanks on a reeling machine, and the apparatus used in carrying out the method, will now be described in greater detail. A beam 1 carries a sheet of substantially parallel warp yarns wound thereon. As shown in FIGS. 1, 2, 3, 4 and 7 this beam is mounted on an axle 2 rotatably mounted on support 9. The beam may carry a sheet formed from any number of warp yarns, preferably 80 to 2000 warp yarns, which have been dyed in sheet form by the slasher process. Alternatively, a smaller beam, carrying a smaller sheet of yarn dyed by the slasher process, may be positioned on the beam stand or drive if desired.

The beam is driven or rotated by a belt 4 attached to motor 5*a*. The sheet of warp yarn 6 unwound from the beam and the sheet is looped around the compensator roll 7. The sheet then passes through the nip between two interacting rolls 8 which rotate in recipricol manner, driven by motor 5*b*.

The function of the compensator roll 7 is to regulate the speed at which the warp yarns are to be released. The compensator roll is rotatably mounted on supports 10, which are pivotably mounted to support 9 by means of pivot pin 10*a*. When the compensator roll moves upward, pivot pin 10*a* rotates. This rotation causes a chain pulley attached to pin 10*a* to rotate.

A chain 10*b* attached to the chain pulley on pin 10*a* and to a second chain pulley on regulator 21 response to rotation of pin 10*a* by rotating the second chain pulley. Rotation of this second chain pulley controls the speed of DC motor 5*a*.

Figure 2:
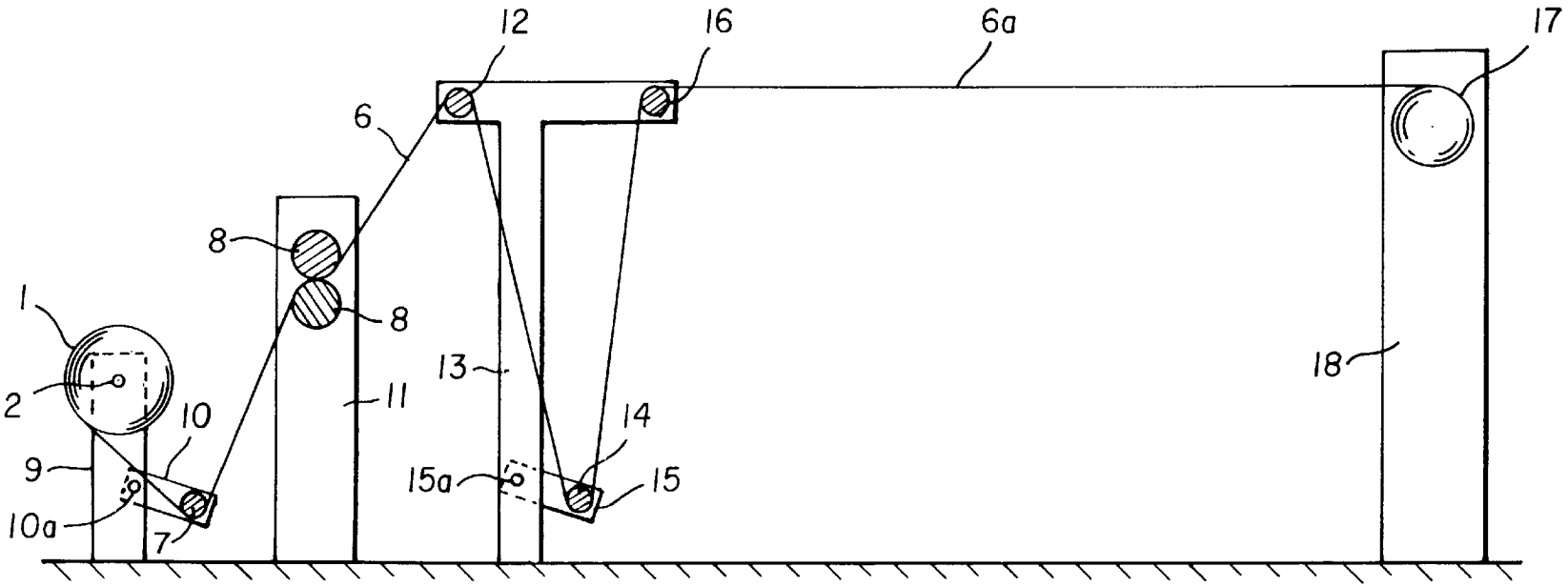
FIG. 2 shows a cross sectional view of the apparatus used to carry out the inventive process.
Figure 3:
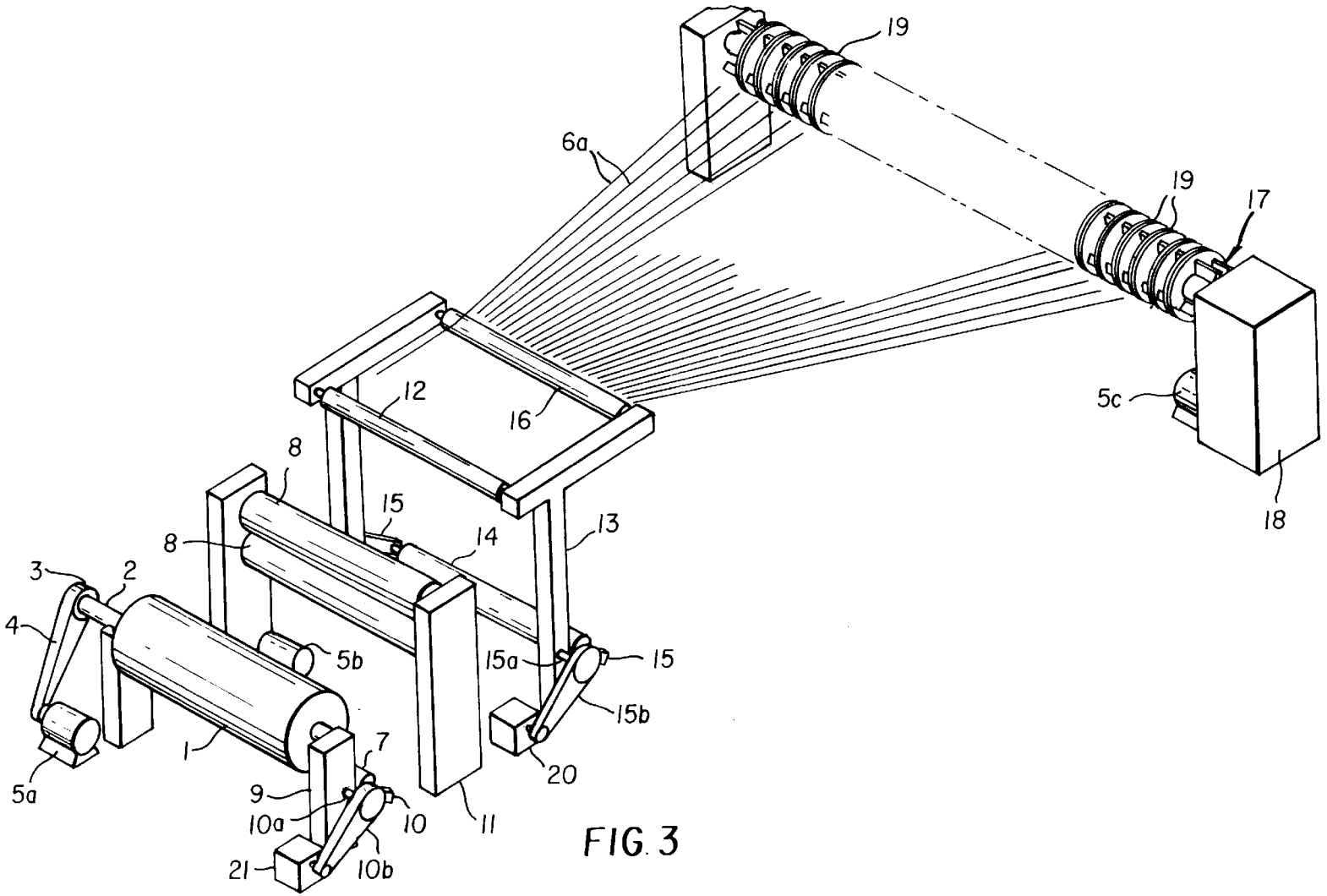
FIG. 3 shows a perspective view of the apparatus used to carry out the inventive process.
Figure 4:
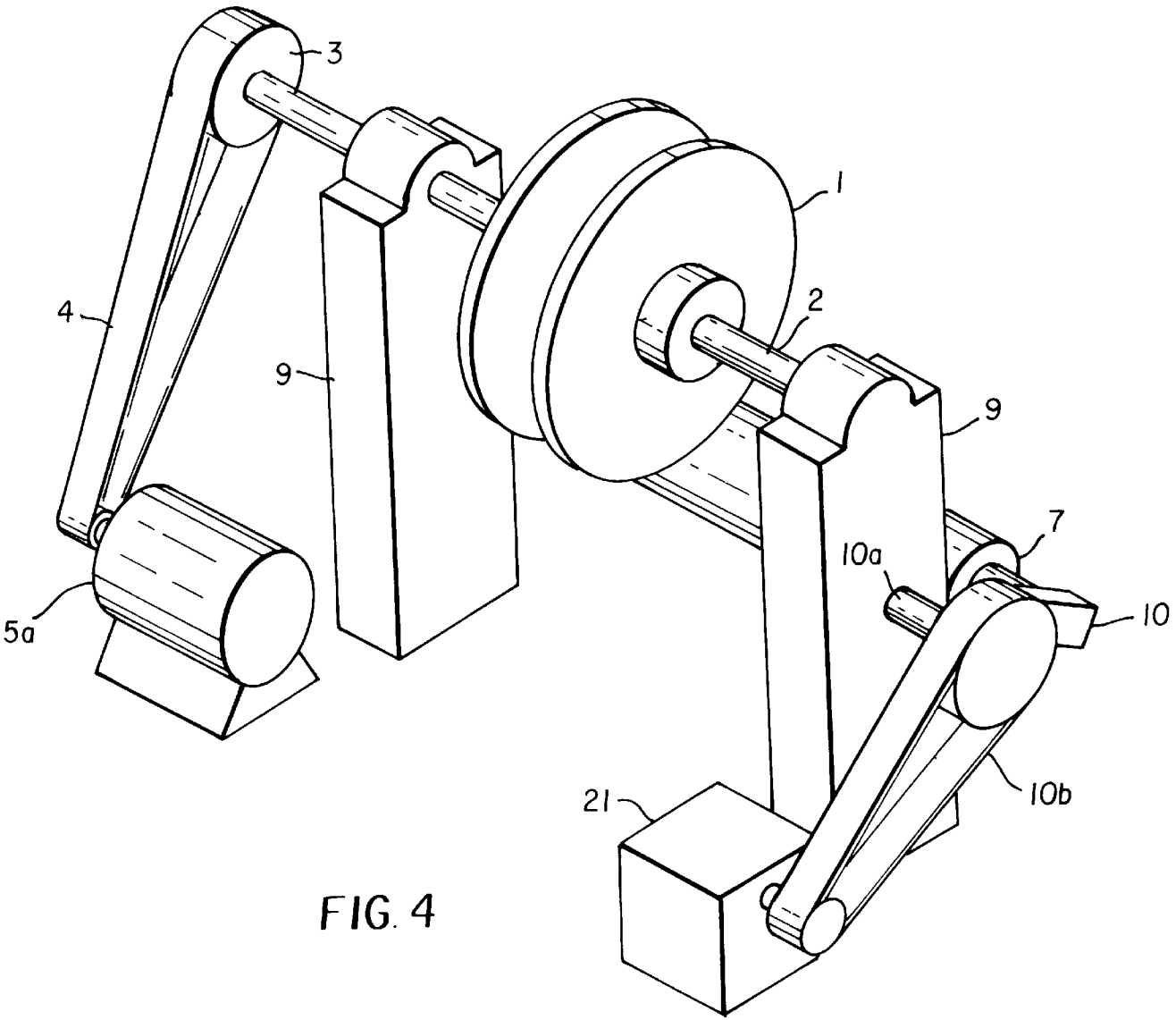
FIG. 4 shows a perspective view of a detail of a beam stand with compensator roll and regulator for the inventive apparatus.
Figure 5:
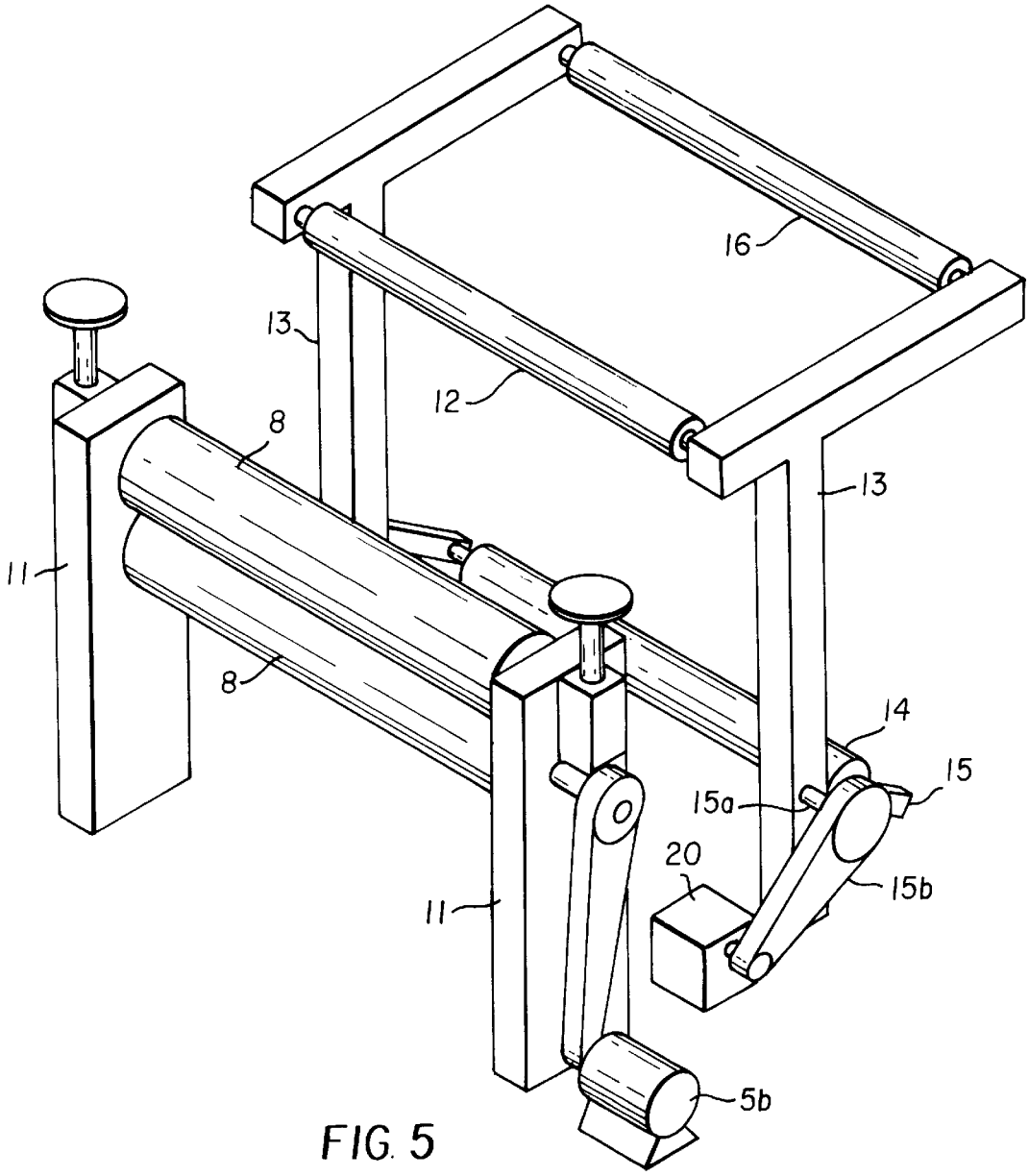
FIG. 5 shows a perspective view of a set of reciprocating rolls and guide rolls for the inventive apparatus.
Figure 6:
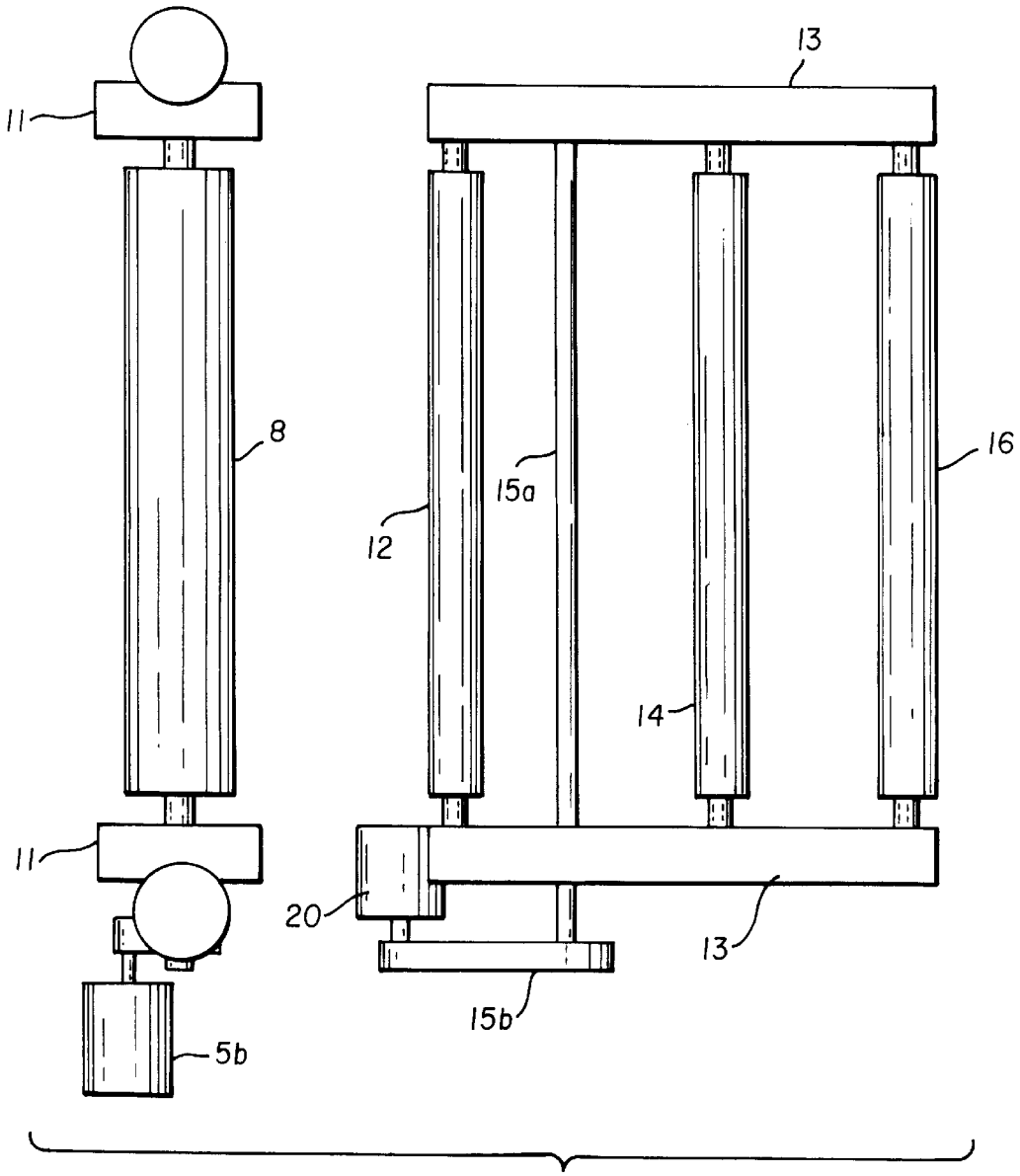
FIG. 6. Is a plan view of the reciprocating rolls and guide rolls for the inventive apparatus.
Figure 7:
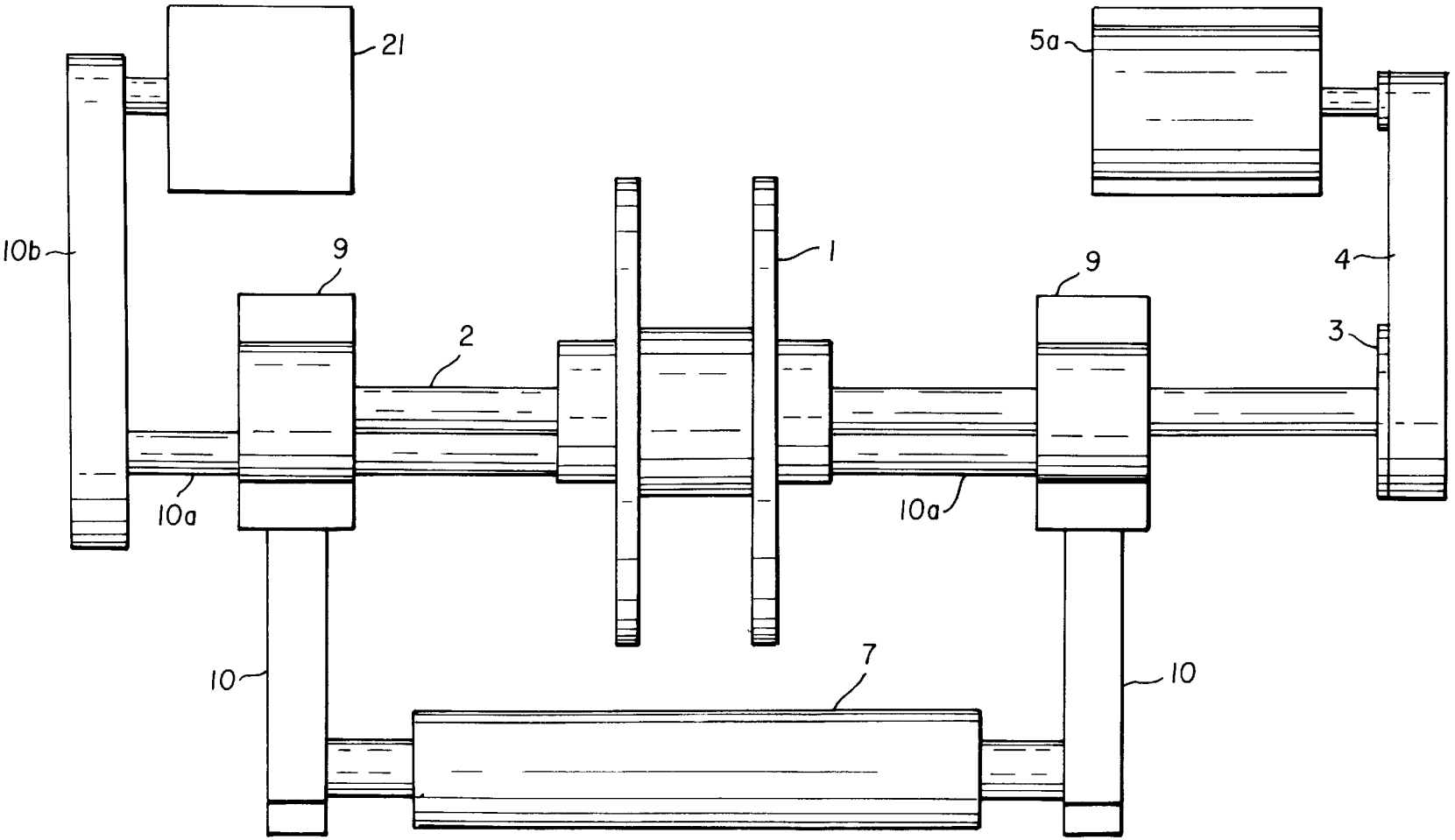
FIG. 7 is a plan view of the beam stand for the inventive apparatus.

The sheet of warp yarns then enters the nip between rotating rolls 8 (FIGS. 2, 5 and 6). It then passes over a guide roll 12 mounted on support 13. Sheet 6 then passes downwards to the second compensator roll 14, and then upwards to a second guide roll 16. Roll 14 is rotatably mounted on supports 15, which are pivotably mounted to support 13 by means of pivot shaft 15*a*. When the compensator roll is moved upward by the sheet of yarn, shaft 15*a*, and a chain pulley attached thereto, start to rotate. This causes a chain running between the pulley on shaft 15*a* and a chain pulley attached to regulator 20 to move, causing the pulley on regulator 20 to rotate. Rotation of the pulley on regulator 20 controls the speed of DC motor 5*b*. It is also possible to use AC variable speed motors as motors 5*a* and 5*b*.

After sheet 6 passes over second guide roll 16, the substantially parallel warp yarns 6*a* making up sheet 6 are separated into individual ends of yarn. Separation of the yarns is very easy, as the yarns are already in sheet form. Each end of yarn is passed to an elongated reel 17 on a hank reeling machine. Preferably, each end of yarn goes to a different point along the length of the reel. Reel 17 is rotatably mounted on support 18, and is driven by a motor 5*c*. Typically, reel 17 can conveniently accommodate up to approximately 80 to 160 yarns 6*a*, although larger reels which can hold more yarns may be used. If more than 160 yarns are present in sheet 6, a plurality of hank reels can be added on the same machine to gather yarns 6*a* simultaneously. In the following discussion, use of a single hank reeling machine will be assumed, unless otherwise noted.

The process of transferring individual threads from the beam to individual hanks begins by rotating reel 17 at low speed. This causes reel 17 to begin gathering threads 6*a* into hanks 19. Since each yarn 6*a* goes to a different point along the length of the reel, each yarn is individually wound into hank form.

As yarns 6*a* are wound onto reel 17, tension is exerted on sheet 6, pulling compensator roll 14 upward. As roll 14 rises, regulator 20 is activated, and causes motor 5*b* driving reciprocating rolls 8 to start rotating the rolls. Rolls 8 act to draw sheet 6 through the nip therebetween and away from beam 1, relieving the tension on sheet 6 as it passes over compensator roll 14.

However, as the sheet is drawn through the nip between rolls 8, the tension on the sheet as it passes around compensator roll 7 increases, lifting roll 7. As roll 7 rises, regulator 21 is activated, which causes motor 5*a* to start rotating beam drive. This causes beam 1 to start rotating, releasing the sheet of warp yarns wound thereon and decreasing the tension on the sheet as it passes over compensator roll 7.

The tension on sheet 6 may be continuously monitored as it passes around compensator roll 14. If the tension on the sheet rises as it loops around roll 14, regulator 20 responds by increasing the speed at which reciprocating rolls 8 draw sheet 6 through the nip. This decreases the tension on the sheet as it passes from rolls 8 to reel 17. This has a major advantage. By monitoring tension on sheet 6 and adjusting the speed of rolls 8 so that the tension on threads 6*a* is maintained at a relatively constant value, sheet 6 tends to travel at a uniform rate, without sudden stops or starts. This greatly reduces the likelihood that threads will break as they pass to the reel. This is an improvement over the prior art process of transferring rope-dyed yarn from a beam to bobbins in multiple stages, which tends to cause excessive thread breakage. The current process minimizes breakages and, in turn, allows production of finer yarns. In case of breakage, it is very easy to tie a knot to join the broken ends.

Also, if the tension on the sheet increases, regulator 20 increases the rate at which rolls 8 draw sheet 6 through the nip, increasing the tension on the sheet as it passes roll 14.

This prevents tangling of threads 6*a* due to formation of excessive slack in the sheet. Preferably, the tension on the sheet is maintained at a substantially constant value.

Similarly, the tension on sheet 6 may be continuously monitored as it passes around compensator roll 7. If the tension on the sheet rises, regulator 20 increases the speed at which beam 1 releases sheet 6. This decreases the tension on the threads as they pass from beam 1 to rolls 8, reducing the likelihood of thread breakage in sheet 6. If the tension on the sheet falls below a defined minimum value, the speed at which beam 1 releases sheet 6 is decreased, preventing formation of excessive slack in the sheet.

This also allows the speed at which the process is carried out to be increased at will simply by gradually increasing the speed at which reel 17 is rotated. Compensators 20 and 21 will then act to increase the speed at which beam 1 and rolls 8 feed sheet 6 to reel 17 while preventing sudden changes in the tension applied to the sheet.

Finally, by maintaining the tension on warp yarns at a relatively constant value, the likelihood that the warp yarns will experience sudden jerks as they are wound off of the beam and onto the individual reels is reduced greatly. Again, this leads to a dramatic reduction in thread breakage.

After separated ends of yarn 6*a* are wound onto reel 17 in the form of loose hanks, the loose hanks are removed from reel 17. Ends of yarn 6*a* may then be easily unwound from the hanks and wound onto-cones for use in knitting or in weaving of plaid fabrics using any conventional process.

Preferably, beam 1 carries a sheet of substantially parallel warp yarns which have been dyed in sheet form by the slasher process. The slasher process allows preparation of a sheet of dyed yarn using any of the available dyes, unlike rope dyeing, which cannot be used for reactive or direct dyes. Up to now, yarn dyed by the slasher process has only been used for weaving. This invention makes it possible for yarn which has been dyed in sheet by the slasher process to be transferred from a beam to cones for use in making knit fabrics or woven plaid fabrics. Also, if the sheet is made from yarns having different colors which have been wound onto the same beam, the different colored yarns can be conveniently separated and wound to separate cones.

However, it is possible to carry out the inventive process with rope-dyed yarn which has been separated and wound onto a beam.

INDUSTRIAL APPLICABILITY

The current invention is useful in separating individual yarns which have been dyed in sheet form by the slasher process and wound onto a beam into individual hanks, and then into cones for use in knitted or woven fabrics. Even yarn dyed by Indigo or vat dyes can be used in knitting, as this process allows them to be wound into suitable packages.

What is claimed is:

1. A method of winding yarn into hanks, comprising the steps of:

a) loading at least one beam having a sheet of substantially parallel individual ends of yarn wound thereon onto a first rotatable beam stand;

b) unwinding an end of the sheet of ends of yarn from the beam and passing the sheet through a nip between two interacting rolls;

c) separating the parallel ends of yarn in the sheet from each other;

d) guiding each of the separated ends of yarn to an elongated rotatable reel, with the proviso that each end of yarn is guided to a different point along the length of the reel;

e) winding the ends of yarn onto the rotatable reel by rotating the beam to release the sheet of ends of yarn wound thereon at a first rotational velocity; rotating the interacting rolls to draw the sheet of ends of yarn through the nip at a second rotational velocity; and rotating the reel to wind each separated end of yarn onto the reel at a third rotational velocity; and f) controlling the first rotational velocity to prevent sudden changes in a tension applied to the sheet of ends of yarn, and controlling the second rotational velocity to prevent sudden changes in a tension applied to each separated end of yarn.

2. The process of claim 1, wherein the beam has a sheet of substantially parallel ends of yarn which have been dyed wound thereon.

3. The process of claim 2, wherein the ends of yarn have been dyed by the slasher process.

4. The process of claim 3, wherein the ends of yarn have been dyed with a dye selected from the group consisting of Indigo dyes, sulfur dyes, vat dyes, reactive dyes, and direct dyes.

5. The process of claim 2, wherein all the ends of yarn in the sheet have been dyed the same color.

6. The process of claim 2, wherein the sheet of ends of yarn comprises a first group of ends of yarn which have been dyed a first color and a second group of ends of yarn which have been dyed a second color.

7. The process of claim 1, comprising the additional step of:

g) removing each end of yarn from the reel in the form of a loose hank, unwinding each end of yarn from said loose hank, and winding each end of yarn onto a cone.

8. The process of claim 1, comprising the additional step of:

g) removing each end of yarn from the reel in the form of a loose hank, unwinding each end of yarn from said loose hank, and winding each end of yarn to form a package suitable for knitting or weaving.

9. The process of claim 1, wherein step (f) comprises:

f) adjusting the first rotational velocity to maintain the tension on the sheet of ends of yarn at a first substantially constant value, and adjusting the second rotational velocity to maintain the tension on each separated end of yarn at a second substantially constant value.

10. An apparatus for winding yarn into hanks, comprising:

a) a rotatable beam stand receiving a beam having a sheet of substantially parallel individual ends of yarn wound thereon;

b) two interacting rotatable rollers having a nip therebetween, said rollers drawing the sheet from the beam through said nip;

c) a means of separating the parallel ends of yarn in the sheet from each other;

d) an elongated rotatable reel having a defined length, said reel receiving each of the separated ends of yarn at a different point along its length;

e) a means for rotating the beam to release the sheet of ends of yarn wound thereon at a first rotational velocity;

f) a means for rotating the interacting rolls to draw the sheet of ends of yarn through the nip at a second rotational velocity;

g) a means for rotating the reel to wind each separated end of yarn onto the reel at a third rotational velocity;

h) a means for controlling the first rotational velocity to prevent sudden changes in a tension applied to the sheet of ends of yarn; defined upper value and a first defined lower value; and i) a means for controlling the second rotational velocity to prevent sudden changes in a tension applied to each separated end of yarn.

11. The apparatus of claim 10, wherein controlling means (h) and controlling means (i) are further characterized as:

h) a means for controlling the first rotational velocity to maintain the tension on the sheet of ends of yarn at a substantially constant value between a first defined upper value and a first defined lower value; and i) a means for controlling the second rotational velocity to maintain the tension on each separated end of yarn at a substantially constant value between a second defined upper value and a second defined lower value.

* * * * *